United States Patent [19]

Lietzke

[11] Patent Number: 4,689,955

[45] Date of Patent: Sep. 1, 1987

[54] VIBRATION ROLLER HAVING A POWER LIMITING DEVICE

[75] Inventor: Heinz Lietzke, Neuss, Fed. Rep. of Germany

[73] Assignee: Case Vibromax GmbH & Co KG, Fed. Rep. of Germany

[21] Appl. No.: 617,619

[22] Filed: Jun. 5, 1984

[30] Foreign Application Priority Data

Jun. 11, 1983 [DE] Fed. Rep. of Germany ..... 3321443

[51] Int. Cl.[4] ..... F16D 31/02

[52] U.S. Cl. ..... 60/420; 60/428; 60/452; 60/486; 60/487; 60/488; 417/212; 417/216

[58] Field of Search ..... 60/427, 434, 452, 488, 60/420, 430, 486, 484; 417/216

[56] References Cited

U.S. PATENT DOCUMENTS

| | | | |
|---|---|---|---|
| 2,867,091 | 1/1959 | Orloff et al. | 60/427 |
| 3,228,184 | 1/1966 | Harbidge et al. | 60/443 X |
| 3,847,061 | 11/1974 | Ifield | 60/427 |
| 3,869,223 | 3/1975 | Bosch | 417/212 |
| 4,174,614 | 11/1979 | Dezelan | 60/484 |
| 4,544,330 | 10/1985 | Schniederjan | 417/218 |

FOREIGN PATENT DOCUMENTS

| | | | |
|---|---|---|---|
| 1453586 | 4/1969 | Fed. Rep. of Germany | 417/216 |
| 1950827 | 7/1970 | Fed. Rep. of Germany | 417/216 |
| 2395411 | 2/1979 | France | 417/212 |
| 1007887 | 10/1965 | United Kingdom | 60/430 |
| 1455679 | 11/1976 | United Kingdom | 60/486 |
| 1601239 | 10/1981 | United Kingdom | 60/486 |

*Primary Examiner*—Edward K. Look

*Attorney, Agent, or Firm*—Laney, Dougherty, Hessin & Beavers

[57] ABSTRACT

A vibration roller comprises a power limiting device (20) engaging the travelling lever (3), the vibration roller having a prime mover (1), a hydrostatic pump for the travelling drive, which hydrostatic pump is driven by the prime mover and arranged to be controlled by a travelling lever (3), and a vibration drive driven by the prime mover. The power limiting device comprises a stepped piston (27) slidingly movable in a stepped bore (24). The fluid pressure in the travelling drive and in the vibration drive engage the steps thereof. The stepped piston (27) is movable into the setting range of the travelling lever (3), by the sum of the fluid pressures, such that the maximum deflection of the travelling lever is limited to values, at which the total power consumption of the vibration roller does not exceed the limiting power of the prime mover.

22 Claims, 2 Drawing Figures

VIBRATION ROLLER HAVING A POWER LIMITING DEVICE

BACKGROUND OF THE INVENTION

1. Field of the Invention

The invention relates to a vibration roller having a prime mover, a hydrostatic pump drive by the prime mover, a hydraulic travelling drive for the travelling operation of the vibration roller, said travelling drive being connected to the pump, at least one hydraulic vibration drive for the operation of a vibration device of the vibration roller, said vibration drive being adapted to be connected to the prime mover, and at least one travelling lever for controlling the travelling drive, said lever being movable within a setting range.

The invention relates also to a power limiting device for a vibration roller of the above mentioned type.

2. Description of the Prior Art

It is known to provide a hydrostatic pumps with pump zero-stroke regulators. These are spring-loaded hydraulic regulating systems, which automatically limit the power output of the hydraulic pump to avoid an overload of the prime mover driving the hydrostatic pump.

The prior art device controls, independently of the driver, only the power effective for the travelling drive irrespective of other power outputs of the prime mover to steering aids, vibration drives and the like. Furthermore the prior art device only permits variation of the power output of the hydrostatic pump within the power limiting range of the prime mover through a corresponding control of the prime mover. Thereby, however, at the same time also the vibration generator speed of the vibration drive varies, whereby the compacting effect becomes dependent to a high degree on the control of the travelling drive.

SUMMARY OF THE INVENTION

It is the object of the present invention to provide a vibration roller of the above mentioned type, the total output of which does not exceed that of the prime mover with any operating condition of the vibration roller. Furthermore, it is in particular the object of the invention to provide a power limiting device for a vibration roller, by means of which an overload of the prime mover is avoided during the operation of the vibration roller. No automatic increase of the travelling speed is to take place independently of the will of the operator.

According to the invention the achievement of this object, as far as the vibration roller is concerned, is characterized by an automatic power limiting device engaging the travelling lever and limiting its setting range to limit the total power output to the limiting power of the prime mover.

With regard to the power limiting device this object is achieved in that an automatic power limiting device is provided, which is adapted to engage the traveling lever and limits its setting range, and which limits the total power output to the limiting power of the prime mover.

In the vibration roller according to the invention the travelling lever and the power limiting device are so arranged relative to each other, that the travelling lever completely deflected is just in contact with the power limiting device, when the prime mover is at standstill.

In the vibration roller according to the invention, the power limiting device preferably comprises a piston-cylinder-unit connected to the travelling drive and to the vibration drive and having a spring-loaded piston movable into the setting range of the travelling lever and exposed to the feed pressure effective in the travelling drive and in the vibration drive. The piston-cylinder-unit preferably has a cylinder having a stepped bore and a stepped piston slidingly movable in the stepped bore, one step of the stepped bore being connected to the travelling drive and the other step of the stepped bore being connected to the vibration drive, and the cross sections of the steps of the stepped piston being proportional to the maximum feed flow rates of the corresponding hydraulic circuits.

In the vibration roller according to the invention, the steps of the stepped bore and the steps of the stepped piston, respectively, preferably are associated with different vibration modes according to rotary speed and/or direction of rotation, or to a hydrostatic steering support or a hydrostatic steering, and in double vibration roller one step each of the stepped bore and of the stepped piston, respectively, is associated with each vibration drive.

In the vibration roller of the invention the spring loading the piston of the power limiting device is advantageously subjected to a preload, which, at limiting power of the prime mover, is equal to the force of the feed pressure of the travelling drive acting on the piston.

In the vibration roller according to the invention overload of the prime mover is prevented, regardless of the types and numbers of drive devices or hydrostatic auxiliary devices driven by the prime mover in addition to the travelling drive. This is accomplished by a displacement of the travelling lever which adjusts the power output of the hydrostatic pump for the travelling drive, without affecting the power transmitted to the other devices of the vibration roller. In the vibration roller of the invention the setting range of the travelling lever is varied in accordance with the total power output of the prime mover by means of the power limiting device. The total setting range of the travelling lever is available for the control of the travelling operation of the vibration roller only with an an operating mode of the vibration roller, with which less than the total output power of the prime mover is consumed. In all other cases the setting range of the travelling lever is reduced, such that the travelling drive cannot take off more power than that determined by the limiting power of the prime mover and of the other drive devices connected thereto. Automatic displacement of the travelling lever in the sense of increasing of the travelling speed is out of the question.

The invention is illustrated in the drawings and will now be described in detail with the aid of the reference numerals.

DESCRIPTION OF THE PREFERRED EMBODIMENT

Figure 1:
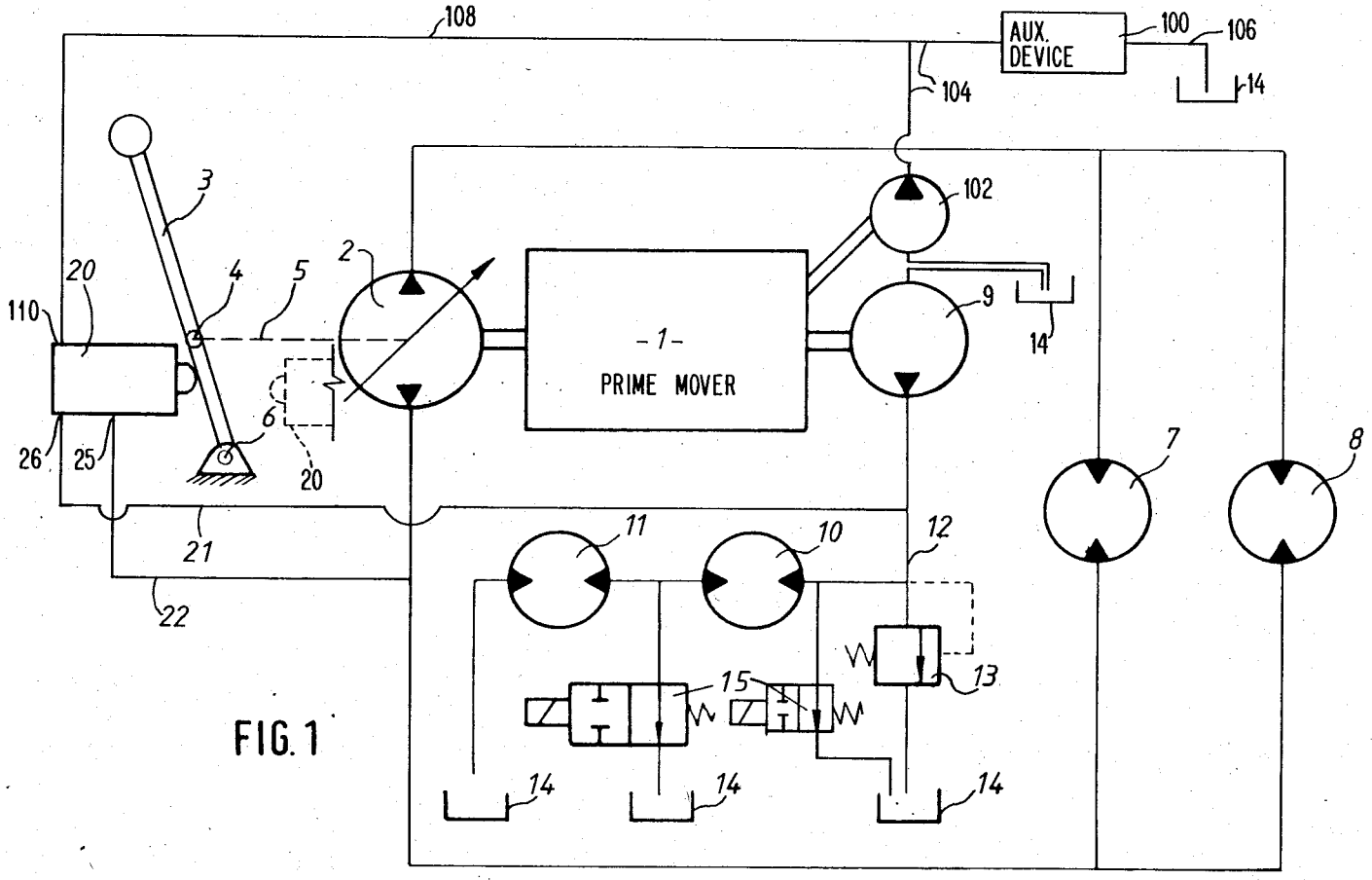
FIG. 1 shows a simplified block diagram of the hydraulic drive of a double vibration roller of the invention.

In the block diagram of a hydraulic drive for a vibration roller illustrated in a simplified manner in FIG. 1, a prime mover 1 can be seen, which can be, for example, an internal-combustion engine. The prime mover 1 drives a hydrostatic pump 2, the power of which is variable through a travelling lever 3, on which an actuating member 5 of the hydrostatic pump 2 is pivoted at 4. The travelling lever 3 is pivoted at 6 on a carriage portion of the vibration roller. A travelling drive is connected to the hydrostatic pump 2, which travelling drive, in the illustrated embodiment has two hydraulic travelling motors 7,8 connected in parallel. A vibration drive is in driving connection with the prime mover 1 and consists of a further hydrostatic pump 9 and a vibration motor 10 and a vibration motor 11 of second order. A pressure limiting device 13 of conventional construction is located in the connecting conduit 12 to the vibration motors 10,11 and is connected to a fluid reservoir 14 and prevents an overload of the vibration motors 10,11. The vibration motor 11 is connected to the fluid reservoir 14 on the outlet side. One 2/2-directional control valve 15 each is located in the connecting conduit 12 and between the vibration motors 10,11, which 2/2 directional control valves form a switch on valves, in one position of which the vibration drive is switched on and the outlet of the vibration motor 10 is connected to the fluid reservoir 14 and to the inlet of the vibration motor 11, respectively. All of the elements of the above described circuits of the vibration roller are composed of conventional, commercially available components, and therefore do not require any detailed description.

A power limiting device 20 is arranged in the setting range of the travelling lever 3, as it is indicated by the dotted line designated by 3'. The power limiting device 20 will now be described in detail with reference to FIG. 2. The power limiting device 20 is connected to the hydrostatic circuit of the vibration drive through a conduit 21 and to the hydraulic circuit of the travelling drive through a conduit 22.

The power limiting device 20 comprises a piston-cylinder-unit, the cylinder 23 of which has a stepped bore 24. The largest step of the stepped bore 24 is connected through a transverse bore 25 to the conduit 22 to the hydrostatic circuit of the travelling drive and the smallest step of the stepped bore 24 is connected through a further transverse bore 26 to the conduit 21 to the hydraulic circuit of the vibration drive. A stepped piston 27 is located in the stepped cylinder 24 and has a large diameter mid-portion 28 slidingly movable in the largest step of the stepped bore 24 and an end portion 29 slidingly movable in the smallest step of the stepped bore 24. The cross sections of the mid-portion 28 and the end portion 29 of the stepped piston 27 are so dimensioned, that they are proportional to the maximum feed flowrates of the fluid in the corresponding hydrostatic circuit, that is in the hydrostatic circuits of the travelling drive and the vibration drive.

At the end of the cylinder 23 opposite the end portion 29, the stepped piston 27 is sealingly guided out of the cylinder 23 and extends with a spherically formed portion into the setting range of the travelling lever 3. A spring 30 is arranged between the large diameter mid-portion 28 of the stepped piston 27 and a shoulder at the end of the cylinder 23, through which the stepped piston 27 extends outward. This spring 30 is opposed to the feed pressure of the fluid in the travelling drive or rather in the largest step of the stepped bore 24 and provided with such a preload, that it balances the force of the pressure, which is exerted by the travelling drive upon the mid-portion 28 of the stepped piston 27 in the largest step of the stepped bore 24, when the prime mover 1 is operated at limiting load and power is transmitted to the travelling drive only. A stop ring 31 introduced into a circumferential groove limits the inwardly directed displacement of the stepped piston 27.

Figure 2:
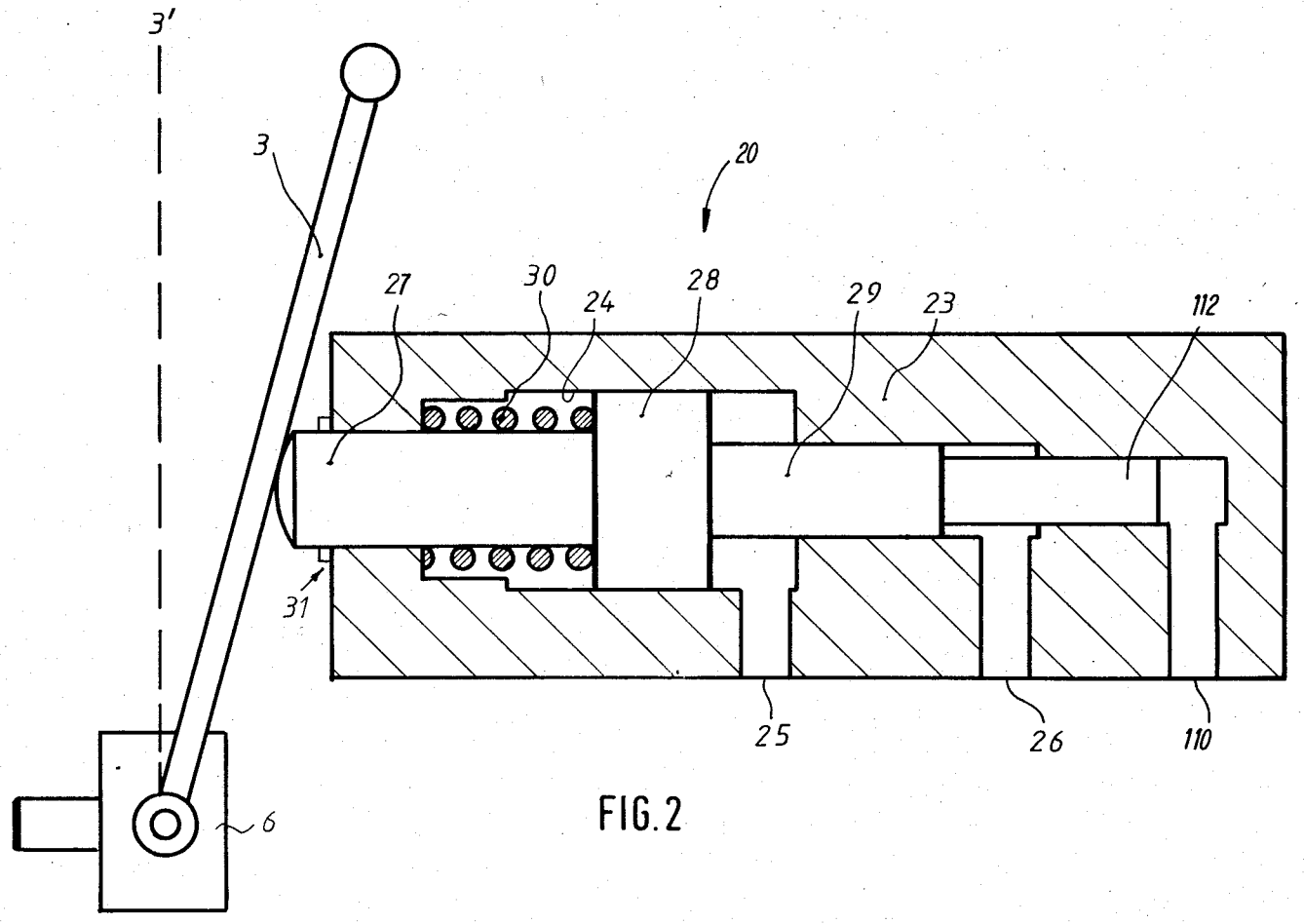
FIG. 2 shows a schematic longitudinal section through a power limiting device in the double vibration roller of FIG. 1.

The stepped piston 27 and the travelling lever 3 are so arranged relative to each other, than the travelling lever 3 can be pivoted from the zero position indicated by the dotted line 3' through the total setting range to the position shown in FIG. 2, at the most. In this position the travelling lever 3 is just in contact with the end of the stepped piston 27 extending out of the cylinder 23. To this position the travelling lever 3 is pivotable at standstill of the prime mover 1. It also occupies this position when the total power of the prime mover 1 is directed exclusively to the travelling drive and the vibration roller is to move with the highest speed possible. If the vibration drive is switched on in addition, then the fluid pressure effective in the vibration drive is applied to the end portion 29 of the stepped piston 27. Thereby the force of the spring 30 is overcome and the stepped piston 27 emerges out of the stepped cylinder 23 by a length corresponding to the force balance, such that the setting range of the travelling lever 3 is correspondingly reduced and the maximum power transmitted to the travelling drive from the hydrostatic pump 2 is limited to a correspondingly small value. In this way the travelling lever 3 can be prevented from deflection into a position, in which the total power taken from the prime mover 1 by the hydrostatic pump 2 and the vibration drives exceeds the limiting power thereof.

In vibration rollers having travelling levers for forward and reverse drive, power limiting devices 20 constructed in the same way can be provided on each side of the travelling lever. Such a second power limiting device is shown in dashed lines in FIG. 1. In the power limiting device of double vibration rollers further steps can be provided in the stepped bore of the cylinder and at the stepped piston for connection to the further vibration drives.

In vibration rollers having a hydrostatic steering support or a hydrostatic steering, further steps can be provided in a corresponding manner in the stepped bore of the cylinder and on the stepped piston, which are associated with the hydrostatic steering support or steering. Correspondingly a further vibration drive differing from the vibration drive first mentioned with regard to the rotary speed and/or the direction of rotation can be taken into account in the power limiting device 20.

For example, an additional auxiliary device 100, which could be either a hydraulic steering support means 100 or a second hydraulic vibration drive means 100, may be powered by a third hydraulic pump 102 which is driven by prime mover 1. A hydraulic fluid supply line 104 supplies fluid from pump 102 to auxiliary device 100. Return line 106 returns fluid to the fluid reservoir 14. A conduit 108 communicated supply line 104 to a third transverse bore 110 which communicated with a third step 112 of piston 27.

I claim:

1. A vibration roller apparatus comprising:

a prime mover;

a hydraulic pump driven by said prime mover;

a hydraulic travelling drive means for providing travelling operation of said vibration roller, apparatus said travelling drive means being hydraulically connected to said pump;

at least one hydraulic vibration drive means for operating a vibration device of said vibration roller, apparatus said vibration drive means only being adapted to be hydraulically powered by said prime mover;

at least one travelling lever for controlling said travelling drive means, said lever being movable within a setting range; and an automatic power limiting means for engaging said travelling lever and for limiting said setting range of said lever to thereby limit a total power output taken from said prime mover to a value no greater than a limiting power of said prime mover thus preventing an overloading of said prime mover.

2. The apparatus of claim 1, wherein:

said travelling lever and said automatic power limiting means are so arranged and constructed relative to each other that when said prime mover is at standstill and when said travelling lever is completely deflected, said travelling lever is just in contact with said power limiting means.

3. The apparatus of claim 1, wherein said power limiting means comprises:

a piston-cylinder unit hydraulically connected to a first hydraulic fluid supply line of said travelling drive means and to a second hydraulic fluid supply line of said vibration drive means;

said piston-cylinder unit having a spring-biased piston movable into said setting range of said travelling lever; and said piston being exposed to the hydraulic pressure in said first and second hydraulic fluid supply lines of said travelling drive means and said vibration drive means, respectively.

4. A hydraulically powered apparatus, comprising:

a prime mover having a limiting power defined as a maximum power output which can be provided by said prime mover without overloading said prime mover;

first and second hydraulic pumps driven by said prime mover;

first and second hydraulically powered devices hydraulically connected to said first and second pumps, respectively;

a control lever, operably associated with said first pump and said first device, for controlling an amount of power taken from said prime mover by said first device, said lever being movable within a setting range; and an automatic power limiting means for engaging said control lever and for limiting said setting range of said lever to thereby limit the amount of power taken from said prime mover by said first device to a value no greater than said limiting power of said prime mover minus an amount of power required by said second device.

5. A vibration roller apparatus comprising:

a prime mover;

a hydraulic pump driven by said prime mover;

a hydraulic travelling drive means for providing travelling operation of said vibration roller apparatus, said travelling drive means being hydraulically connected to said pump;

at least one hydraulic vibration drive means for operating a vibration device of said vibration roller apparatus, said vibration drive means being adapted to be hydraulically powered by said prime mover;

at least one travelling lever for controlling said travelling drive means and further characterized as a means for controlling both forward and reverse movement of said vibration roller apparatus, said lever being movable within a setting range;

an automatic power limiting means for engaging said travelling lever and for limiting said setting range of said lever to thereby limit a total power output taken from said prime mover to a value no greater than a limiting power of said prime mover thus preventing an overloading of said prime mover; and a second automatic power limiting means, located on a side of said travelling lever opposite said first automatic power limiting means, so that the total power output of said prime mover is limited for both forward and reverse movement of said vibration roller apparatus.

6. A vibration roller apparatus comprising:

a prime mover;

a hydraulic pump driven by said prime mover;

a hydraulic travelling drive means for providing travelling operation of said vibration roller apparatus, said travelling drive means being hydraulically connected to said pump;

at least one hydraulic vibration drive means for operating a vibration device of said vibration roller apparatus, said vibration drive means being adapted to be hydraulically powered by said prime mover;

at least one travelling lever for controlling said travelling drive means, said lever being movable within a setting range; and an automatic power limiting means for engaging said travelling lever and for limiting said setting range of said lever to thereby limit a total power output taken from said prime mover to a value no greater than a limiting power of said prime mover thus preventing an overloading of said prime mover, said power limiting means comprising a piston-cylinder unit hydraulically connected to a first hydraulic fluid supply line of said travelling drive means and to a second hydraulic fluid supply line of said vibration drive means, said piston-cylinder unit comprising:

a cylinder having a stepped bore; and a spring-biased, stepped piston slidably movable in said stepped bore and movable into said setting range of said travelling lever, said piston being exposed to the hydraulic pressure in said first and second hydraulic fluid supply lines of said travelling drive means and said vibration drive means, respectively;

wherein:

a first step of said stepped bore is hydraulically communicated with said first hydraulic fluid supply line of said travelling drive means;

a second step of said stepped bore is hydraulically communicated with said second hydraulic fluid supply line of said vibration drive means; and a ratio of a cross-sectional area of a first step of said stepped piston corresponding to said first step of said stepped bore, to a cross-sectional area of a second step of said stepped piston corresponding to said second step of said stepped bore, is proportional to a ratio of a maximum fluid supply flow rate provided to said travelling drive means to a maximum fluid supply flow rate provided to said vibration drive means.

7. The apparatus of claim 6, wherein:

said apparatus includes a second hydraulic vibration drive means corresponding to a second vibration mode of said vibration roller apparatus; and said stepped bore and stepped piston each include associated third steps, said third step of said stepped bore being hydraulically communicated with a third hydraulic fluid supply line of said second hydraulic vibration drive means.

8. The apparatus of claim 6, wherein:

said apparatus includes at least one hydraulic steering support means; and said stepped bore and stepped piston each include associated third steps, said third step of said stepped bore being hydraulically communicated with a third hydraulic fluid supply line of said hydraulic steering support means.

9. The apparatus of claim 6, wherein:

said apparatus includes a second hydraulic travelling drive means; and said stepped bore and stepped piston each include associated third steps, said third step of said stepped bore being hydraulically communicated with a third hydraulic fluid supply line of said second hydraulic travelling drive means.

10. A vibration roller apparatus comprising:

a prime mover;

a hydraulic pump driven by said prime mover;

a hydraulic travelling drive means for providing travelling operation of said vibration roller apparatus, said travelling drive means being hydraulically connected to said pump;

at least one hydraulic vibration drive means for operating a vibration device of said vibration roller apparatus, said vibration drive means being adapted to be hydraulically powered by said prime mover;

at least one travelling lever for controlling said travelling drive means, said lever being movable within a setting range; and an automatic power limiting means for engaging said travelling lever and for limiting said setting range of said lever to thereby limit a total power output taken from said prime mover to a value no greater than a limiting power of said prime mover thus preventing an overload of said prime mover, said power limiting means comprising:

a piston-cylinder unit hydraulically connected to a first hydraulic fluid supply line of said travelling drive means and to a second hydraulic fluid supply line of said vibration drive means;

said piston-cylinder unit having a spring-biased piston movable into said setting range of said travelling lever; and said piston being exposed to the hydraulic pressure in said first and second hydraulic fluid supply lines of said travelling drive means and said vibration drive means, respectively;

wherein, the spring of said spring-biased piston is preloaded to a preload foce substantially equal to a force applied to said piston by the hydraulic pressure in said first hydraulic fluid supply line to said travelling drive means when said prime mover is being operated at its limiting power and power from said prime mover is being transmitted only to said travelling drive means.

11. A hydraulically powered apparatus comprising:

a prime mover having a limiting power defined as a maximum power output which can be provided by said prime mover without overloading said prime mover;

first and second hydraulic pumps driven by said prime mover;

first and second hydraulically powered devices hydraulically connected to said first and second pumps, respectively;

a control lever, operably associated with said first pump and said first device, for controlling an amount of power taken from said prime mover by said first device, said lever being movable within a setting range; and an automatic power limiting means for engaging said control lever and for limiting said setting range of said lever to thereby limit the amount of power taken from said prime mover by said first device to a value no greater than said limiting power of said prime mover minus an amount of power required by said second device, said automatic power limiting means comprising:

a cylinder having a first cylindrical bore portion and a reduced diameter second cylindrical bore portion;

a piston having a first piston portion slidably received in said first cylindrical bore portion of said cylinder, and having a reduced diameter second piston portion slidably received in said second cylindrical bore portion; and said first cylindrical bore portion being hydraulically communicated with a hydraulic fluid supply line of one of said first and second devices, and said second cylindrical bore portion being hydraulically communicated with a hydraulic fluid supply line of the other of said first and second devices;

wherein, a ratio of a cross-sectional area of said first cylindrical bore portion to a cross-sectional area of said second cylindrical bore portion is proportional to a ratio of a maximum fluid supply flow rate provided to said one of said first and second devices, to a maximum fluid supply flow rate provided to said other of said first and second devices.

12. The apparatus of claim 11, wherein:

said first cylindrical bore portion is hydraulically communicated with said hydraulic fluid supply line of said first device.

13. The apparatus of claim 12, wherein:

said piston is biased away from said lever by a resilient biasing means; and said resilient biasing means is preloaded to a preload force substantially equal to a force applied to said piston by the hydraulic pressure in said hydraulic fluid supply line of said first device when said prime mover is being operated at its limiting power and power from said prime mover is being transmitted only to said first device.

14. The apparatus of claim 11, wherein:

said control lever and said automatic power limiting means are so arranged and constructed relative to each other that when said prime mover is at standstill, and when said lever is completely deflected, said lever is just in contact with said power limiting means.

15. The apparatus of claim 11, wherein:

said apparatus is a vibration roller apparatus;

said first device is a hydraulic travelling drive means for providing travelling operation of said vibration roller apparatus; and said second device is a hydraulic vibration drive means for operating a vibration device of said vibration roller apparatus.

16. The apparatus of claim 15, wherein:

said cylinder includes a third cylindrical bore portion;

said piston includes a third piston portion slidably received in said third bore portion; and said third cylindrical bore portion is hydraulically communicated to a hydraulic fluid supply line of a third hydraulically powered device.

17. The apparatus of claim 16, wherein:

said third device is a second hydraulic vibration drive means.

18. The apparatus of claim 16, wherein:

said third device is a hydraulic steering support means.

19. The apparatus of claim 16, wherein:

said third device is a second hydraulic travelling drive means.

20. The apparatus of claim 16, wherein:

said third cylindrical bore portion of said cylinder is of reduced diameter relative to said second bore portion.

21. A hydraulically powered apparatus, comprising:

a prime mover having a limiting power defined as a maximum power output which can be provided by said prime mover without overloading said prime mover;

first and second hydraulic pump means driven by said prime mover;

first and second hydraulically powered means hydraulically connected to said first and second pump means, respectively;

a manually actuated control lever, operably associated with said first pump means and said first hydraulically powered means, for controlling an amount of power taken from said prime mover by said first hydraulically powered means, said lever being movable within a setting range;

means for controlling said second hydraulically powered means independently of said first hydraulically powered means; and an automatic power limiting means, including:

a stop means for engaging said control lever; and an actuator means, operably associated with said stop means, for moving said stop means into said setting range of said control lever and for thereby limiting said setting range, said actuator means being controlled as a function of amounts of power required by said first and second hydraulically powered means to thereby limit an amount of power taken from said prime mover by said first hydraulically powered means to a value no greater than said limiting power of said prime mover minus said amount of power required by said second hydraulically powered means.

22. A vibration roller apparatus comprising:

a prime mover;

a hydraulic pump driven by said prime mover;

a hydraulic travelling drive means for providing travelling operation of said vibration roller apparatus, said travelling drive means being hydraulically connected to said pump;

at least one hydraulic vibration drive means for operating a vibration device of said vibration roller apparatus, said vibration drive means being adapted to be hydraulically powered by said prime mover;

at least one travelling lever for controlling said travelling drive means, said lever being movable within a setting range; and an automatic power limiting means for preventing an overloading of said prime mover, said automatic power limiting means comprising:

a stop means for engaging said travelling lever; and an actuator means, operably associated with said stop means, for moving said stop means into said setting range of said lever and for thereby limiting said setting range, said actuator means being controlled as a function of amounts of power required by said hydraulic travelling drive means and said hydraulic vibration drive means to thereby limit an amount of power taken from said prime mover by said hydraulic travelling drive means to a value no greater than said limiting power of said prime mover minus said amount of power required by said hydraulic vibration drive means.

* * * * *

UNITED STATES PATENT AND TRADEMARK OFFICE

CERTIFICATE OF CORRECTION

PATENT NO. : 4,689,955

DATED : September 1, 1987

INVENTOR(S) : Heinz Lietzke

It is certified that error appears in the above-identified patent and that said Letters Patent are hereby corrected as shown below:

Column 1, line 8, delete "drive" and insert --driven-- therefor; line 21, delete "a".

Column 4, line 12, delete "than" and insert --that-- therefor; line 63, delete "communicated" and insert --communicates-- therefor; line 64, delete "communicated" and insert --communicates-- therefor.

Claim 1, line 5, delete "," after "roller" and insert --,-- after "apparatus"; line 9, delete "," after "roller"; line 10, insert --,-- after "apparatus"; line 10, delete "only"; line 12, insert --only-- after "means" and before ",".

Claim 10, line 35, delete "foce" and insert --force-- therefor.

Signed and Sealed this

Nineteenth Day of January, 1988

*Attest:*

DONALD J. QUIGG

*Attesting Officer*

*Commissioner of Patents and Trademarks*